US009512575B2

(12) United States Patent
Bornemann et al.

(10) Patent No.: US 9,512,575 B2
(45) Date of Patent: Dec. 6, 2016

(54) SOIL COMPACTOR

(71) Applicant: Hamm AG, Tirschenreuth (DE)

(72) Inventors: Detlef Bornemann, Leonberg (DE); Andreas Weiβ, Leonberg (DE)

(73) Assignee: Hamm AG, Tirschenreuth (DE)

( * ) Notice: Subject to any disclaimer, the term of this patent is extended or adjusted under 35 U.S.C. 154(b) by 0 days.

(21) Appl. No.: 14/812,412

(22) Filed: Jul. 29, 2015

(65) Prior Publication Data

US 2016/0053444 A1 Feb. 25, 2016

(30) Foreign Application Priority Data

Aug. 19, 2014 (DE) ..... 10 2014 216 440

(51) Int. Cl.
*E01C 19/23* (2006.01)
*E01C 19/26* (2006.01)
*B05B 13/00* (2006.01)

(52) U.S. Cl.
CPC ..... *E01C 19/238* (2013.01); *B05B 13/005* (2013.01); *E01C 19/23* (2013.01); *E01C 19/264* (2013.01)

(58) Field of Classification Search
CPC ..... E01C 19/004; E01C 19/23; E01C 19/266; E01C 19/00; E01C 19/264; E01C 19/238; E01C 7/36; E02D 3/02; B05B 13/005
See application file for complete search history.

(56) References Cited

U.S. PATENT DOCUMENTS 4,009,967 A * 3/1977 Layton ..... E01C 19/238 239/223
6,827,524 B2 * 12/2004 Starry, Jr. ..... E01C 19/238 404/122
8,500,363 B1 * 8/2013 Ries ..... E01C 19/264 404/104
8,636,443 B2 * 1/2014 Ries ..... 239/1
8,827,593 B1 * 9/2014 Oetken ..... E01C 19/28 404/117
2013/0248556 A1 * 9/2013 May ..... E02F 3/8152 222/1

FOREIGN PATENT DOCUMENTS

| | | |
|---|---|---|
| GB | 08932 | 8/1916 |
| JP | 2004-244883 | 9/2004 |
| JP | 2007 070903 | 3/2007 |
| JP | 2007070903 | 3/2007 |

OTHER PUBLICATIONS

English Translation of JP2007070903, Abe et al., Feb. 21, 2016.*
German PTO Search Report issued Apr. 24, 2015.
EP Search report mailed Jan. 19, 2016.

* cited by examiner

*Primary Examiner* — Abigail A Risic
(74) *Attorney, Agent, or Firm* — Rankin, Hill & Clark LLP

(57) ABSTRACT

A soil compactor—comprising at least one compactor roller rotatable about a roller rotational axis and a liquid storage/dispensing system for storing and dispensing liquid to at least one compactor roller, wherein the liquid storage/dispensing system comprises at least one main liquid storage and one main liquid pipe associated with this—is characterized in that at least two main liquid storages are provided, wherein main liquid pipes of at least two main liquid storages are in connection with a common filling connection for filling the main liquid storage associated with these, and/or at least one, preferably all main liquid storages can be filled and emptied via main liquid pipes associated with these.

13 Claims, 2 Drawing Sheets

SOIL COMPACTOR

Figure 1:
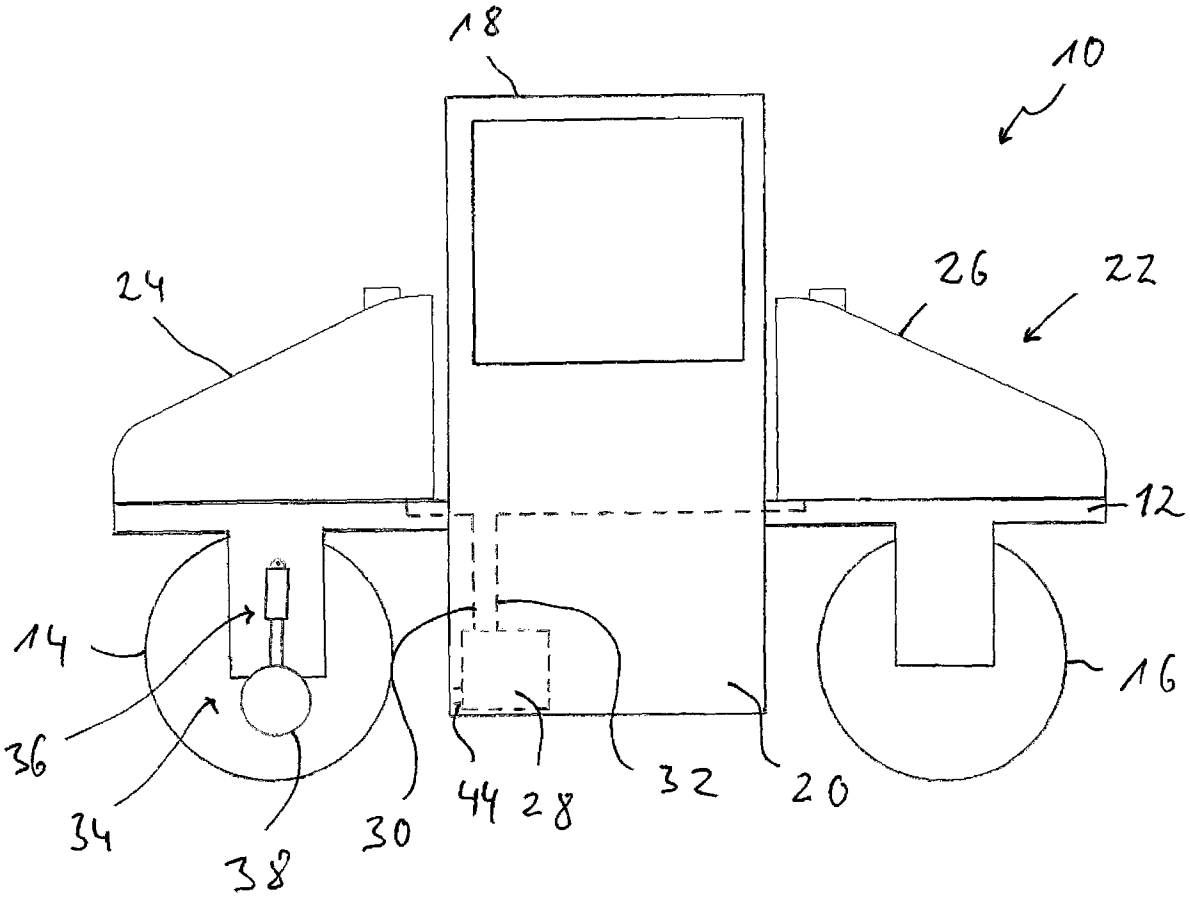

The present invention relates to a soil compactor comprising at least one compactor roller rotatable about a roller rotational axis a liquid storage/dispensing system for storing and dispensing liquid to at least one compactor roller, wherein the liquid storage/dispensing system comprises at least one main liquid storage and a main liquid pipe associated with this.

Such soil compactors, generally what are known as self-propelled soil compactors, are used—for example—in road construction to compact the road subsoil or the road surface, in particular a blacktop. When compacting lightly adhering materials such as asphalt, it must be ensured that the areas of the soil compactor—in particular the compactor rollers—coming in contact with this material are treated so that the material to be compacted does not adhere to these.

From U.S. Pat. No. 8,500,363 B2, a self-propelled soil compactor is known which comprises a respective compactor roller in a front and a rear area of a machine frame, which in this exemplary embodiment are provided by a group of wheels with pneumatic tires that are adjacent to one another in the direction of a respective compactor roller rotational axis. In the sense of the present invention, such a group of adjacent wheels may also be considered as providing a compactor roll.

This known soil compactor includes a liquid storage/dispensing system with a liquid storage. The liquid (i.e. water) stored in this liquid storage is conveyed by a pump towards a first liquid dispensing unit, via which the liquid is applied to the surface of one of the compactor rollers, i.e. to the surface of the tires or wheels providing this compactor roller. In addition, this pump conveys liquid to an edge treatment device arranged next to one of the rollers, which edge treatment device is used to smooth or bevel the edge area of a roadway to be built from asphalt material to be compacted. A second liquid dispensing unit is associated with this edge treatment device. The liquid supply to the first liquid dispensing unit and the second liquid dispensing unit may be interrupted by respective valves which are arranged in respective liquid dispensing pipes from the liquid pump to the liquid dispensing units.

It is the object of the present invention to provide a soil compactor having the design described above, wherein the process of filling a liquid storage can be performed in a simple manner.

According to the invention, this object is achieved by a soil compactor comprising at least one compactor roller rotating about a roller rotational axis a liquid storage/dispensing system for storing and dispensing liquid to at least one compactor roller, wherein the liquid storage/dispensing system comprises at least one main liquid storage and main liquid pipe associated with this.

It is further provided that at least two main liquid storages are provided, wherein main liquid pipes of at least two main liquid storages are in connection with a common filling connection for filling the main liquid storages associated with these and/or in that at least one, preferably all main liquid storages can be filled and emptied via these assigned main liquid pipes.

The present invention provides a soil compactor in which, due to the existing arrangements for filling the one or more main liquid storages with liquid, the filling is simple to carry out. If there are several main liquid storages provided, these can be filled jointly due to the structure according to the invention, namely via the common filling connection to which, for example, a pressure pipe may be connected for filling of the liquid under pressure. According to another very advantageous aspect, it may alternatively or additionally be provided that, via a main liquid pipe associated with a main liquid storage, this may be both filled and emptied. The insertion of a filling tube, for example into an opening, and the filling via this opening may thus be avoided in principle, independently of an existing main liquid pipe. In particular when utilizing a main liquid pipe intended per se for emptying a main liquid storage for filling said main liquid storage, the filling may take place under pressure, which shortens the filling process significantly.

In a particularly advantageous embodiment of the soil compactor designed according to the invention, it may be provided that at least one main liquid storage is in connection with a liquid buffer via a main liquid pipe associated with said main liquid storage, wherein a filling connection for filling the at least one main liquid storage connected with this via the liquid buffer is associated with said liquid buffer. Such a liquid buffer may be positioned on the machine frame so that it is in principle easily accessible. Thus, there is no need to interact with the main liquid storages themselves while performing a filling operation, in particular when filling multiple main liquid storages via such a liquid buffer. In particular, for this it may be provided that main liquid pipes of at least two main liquid storages establish a connection between these main liquid storages and the liquid buffer.

In order on the one hand to be able to ensure an easy access to a filling connection, on the other hand to be able to make sure that especially the emptying process of one or more of the main storages may be carried out via the liquid buffer, it is proposed that the filling connection is provided in a lower area of the liquid buffer, and/or that the liquid buffer is arranged in the vertical direction under at least one, preferably all main liquid storages.

In order to be able to carry out the emptying of one or more main liquid storages in a defined manner, in particular to be able to conduct the liquid stored therein to a compactor roller, it is proposed that a main liquid pipe of at least one, preferably all main liquid storages is in connection with at least one liquid pump. For this purpose, it may be provided that an intermediate liquid pipe leads from the liquid buffer to at least one liquid pump. The at least one liquid pump is therefore arranged downstream of the liquid buffer and located in the flow path between the liquid buffer and the system area to be fed.

To dispense the liquid stored in one or more main liquid storage, for example towards at least one compactor roller, it is further proposed that at least one liquid pump is in connection—via a liquid dispensing pipe—with at least one liquid dispensing unit, preferably comprising a plurality of liquid dispensing nozzles.

In particular during compaction of asphalt, it must be ensured that the surface of the or each compactor roller coming into contact with the asphalt material is continuously wetted with liquid in order to avoid adhesion of asphalt to the compactor roller. To increase the certainty, it is therefore proposed that at least two liquid pumps are provided, connected in parallel between the intermediate liquid pipe and the liquid dispensing pipe. Via the provision of two liquid pumps connected in parallel, it is ensured that the system area to be fed may be supplied via each of these liquid pumps designed with sufficient conveying capacity, so that in case of failure of one of the liquid pumps work may immediately be continued with the other liquid pump.

The soil compactor according to the invention may, for example, be designed with two compactor rollers, wherein a liquid dispensing system is associated with each compactor roller. Alternatively or additionally, it may be provided that a main liquid storage is arranged above each compactor roller. This leads to a uniform weight distribution, and thus increases the quality of the compaction process to be carried out.

According to another very advantageous aspect of the present invention, it may be provided that a liquid discharge opening and/or a liquid dispensing member, preferably a liquid tap, is provided at the liquid buffer. Liquid can be drained via the liquid discharge opening, for example in winter when decommissioning a soil compactor, so that there is no danger that damage is caused by freezing liquid. The provision of a liquid dispensing member, such as a liquid tap, offers the possibility that personnel working at the construction site, in particular the operator of the soil compactor, can—for example—clean their hands with the liquid stored at the compactor.

According to further advantageous aspects of the present invention, it may be provided that the liquid buffer is constructed with plastic material, preferably PE material, and/or is fixed to the machine frame by means of tension belt attachment, and/or is designed as a rotating injection mold part.

Furthermore, it may be provided that the filling connection is formed as a pressurized pipe connection, preferably a C-pipe connection; and/or the filling connection is designed as a tilt angle connector; and/or a valve assembly substantially preventing the escape of liquid from the liquid buffer through the filling opening is associated with the filling connection; and/or a fill level detection arrangement is associated with the liquid buffer.

The present invention is described below in detail with reference to accompanying Figures. It shows:

FIG. 1 a soil compactor with two compactor rollers at a machine frame, in a principle side view.

Figure 2:
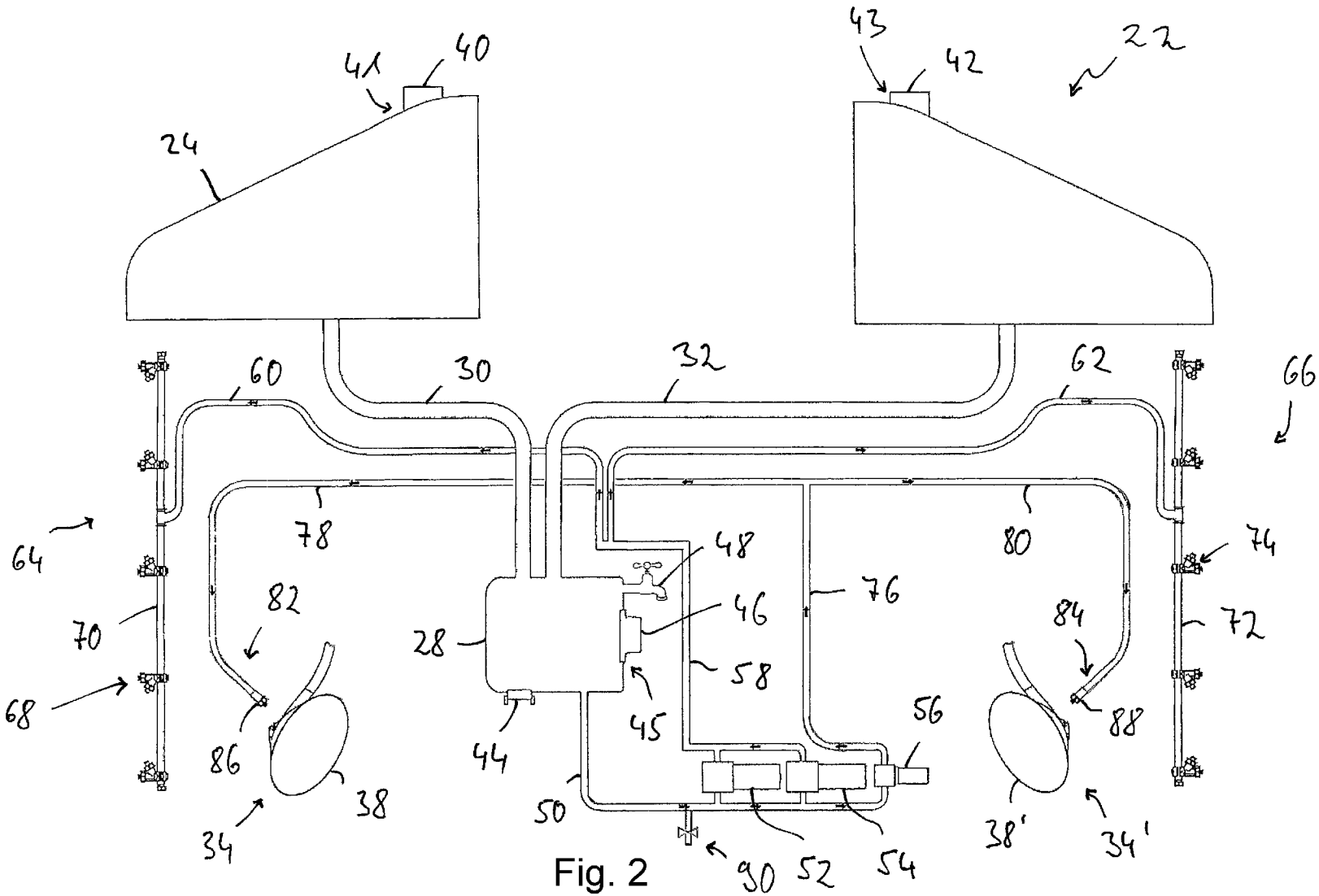

FIG. 2 a liquid storage/dispensing system for the soil compactor shown in FIG. 1.

In FIG. 1, a self-propelled soil compactor 10—usable for example for compacting asphalt material for a road—is shown in a principle representation in side view. The soil compactor 10 comprises a machine frame 12 (for example embodied as an articulated frame) on which two compactor rollers 14, 16 are supported so as to be rotatable around respective compactor roller rotational axes. The two compactor rollers 14, 16 are arranged successively on the machine frame 12 in a direction of movement of the soil compactor 10. For example, one of them may be provided at a front carriage and one of them at a rear carriage of the machine frame. It should be noted in this context that, in the sense of the present invention, each of the compactor rollers 14, 16 may be constructed as a roller designed with a roller casing of steel material that is continuous in the direction of the compactor roller rotational axis. However, one or both of the compactor rollers 14, 16 could in principle also be formed with a plurality of consecutive individual wheels in the direction of the respective compactor roller rotational axis, for example with pneumatic tires which then in their entirety then define a compactor roller in the meaning of the present invention. Basically, however, each wheel of such a group of adjacently arranged wheels could also be considered a compactor roller in the sense of the present invention.

In the area between the two compactor rollers 14, 16, a driver's stand 18—for example a driver's cabin—is provided on the machine frame 12. From the driver's stand 18, an operator can control the soil compactor 10 during an operation. In an area 20 below the driver's stand 18, the drive unit—thus for example a diesel generator—may be supported by the machine frame 12. The various areas of the system of the soil compactor 10 that are to be powered may be fed via this drive unit with corresponding drive power, for example via a hydraulic fluid circuit, a generator/motor or the like.

The soil compactor 10 includes a liquid storage/dispensing system (generally designated with 22). In FIG. 1, of this liquid storage/dispensing system (whose design and operation will be described in detail below with reference to FIG. 2) two main liquid tanks 24, 26 can be seen which are respectively positioned above a compactor roller 14, 16, supported by the machine frame 12. Furthermore, a liquid buffer 28 can schematically be seen in FIG. 1, which liquid buffer 28 is supported on the machine frame 12 in the area 20 below the driver's stand 18, thus in that area in which the drive unit may also be housed. Main pipes 30, 32 leading from the main liquid storages 24, 26 to the liquid buffer 28 may also be seen schematically in FIG. 1. The liquid contained in the main liquid storages 24, 26 may be dispensed to the liquid buffer 28 via the main liquid pipes 30, 32, and then be conveyed in the manner described below to system areas of the soil compactor 10 to be fed with liquid. These system areas include both compactor rollers 14, 16, the surface of which must be wetted with liquid in particular during an asphalt compaction process to prevent the adhesion of asphalt material to the compactor rollers 14, 16. Another system area to be fed with liquid (i.e. water, for example) is shown in FIG. 1 in association with the compactor roller 14. This system area includes an edge treatment device 34 which is arranged laterally next to the compactor roller 14 and may be used for treating a road edge. This edge treatment device 34 includes an edge treatment wheel 38—adjustable in the vertical direction via a hydromechanical actuator 36, for example—which may be configured as a bevel gear and, when in contact with the road edge to be treated, may press on this and bevel it. The edge treatment wheel 38 may be brought into a suitable height position to carry out such an edge treatment operation and be driven for rotation. The soil compactor 10 may include two such edge treatment devices 34, each at one side thereof as viewed in the direction of the compactor roller rotational axes. For example, it may be provided that such an edge treatment device is also associated with the compactor roller 16 provided on the other end area of the machine frame 12, on the side of the soil compactor 10 not visible in FIG. 1, so that a respective edge area may be treated with the associated edge treatment device regardless of the orientation or direction of movement of the soil compactor 10.

The structure and operation of the liquid storage/dispensing system 22 are described below with reference to FIG. 2.

In FIG. 2, the two main liquid storages 24, 26 can be seen that each may have, in their upper area, an opening 41, 43 closable for example by a seal 40, 42, for example a screw-top. These openings 41, 43 or, respectively, the respective associated seal 40, 42 may on one hand serve to vent the respective main liquid storage 24, 26 during a filling process; on the other hand, a filling of main liquid storage 24, 26 could also in principle take place via these openings 41, 43 with respective seals 40, 42 removed.

The main liquid pipe 30 associated with the main liquid storage 24 can also be seen in FIG. 2, which main liquid pipe 30 leads from a lower area of the main liquid storage 24 to the liquid buffer 28. The main liquid pipe 32 associated with the main liquid storage 26 accordingly leads from a lower area of the main liquid storage 26 to the liquid buffer 28. It is apparent that the two main liquid pipes 30, 32 open into an upper area of the liquid buffer 28. Since the liquid buffer 28 is arranged vertically under both main liquid storages 24, 26, it is ensured that the main liquid storages 24, 26 may be completely emptied via the main liquid pipes 30, 32 into the liquid buffer 28.

The liquid buffer 28 is also associated with a filling connection 44 provided in a lower area of said liquid buffer 28. For example, this filling connection 44—executed as angle connection or, respectively, pressurized hose connection, preferably what is known as a C-pipe connection—may be used in order to fill the two main liquid storages 24, 26 via the liquid buffer and the main liquid pipes 30, 32, leading to this. This means that the main liquid pipe 30 or, respectively, 32 that is associated with a respective main liquid storage 24 or, respectively, 26 may be used not only for emptying the main liquid storage 24 or, respectively, 26 but also for filling of the same. Since the filling connection 44 is constructed so that it is suitable for pressurized filling, the capability this exists to fill the two main liquid storages in parallel to each other in a very short time. The air, that is thereby displaced from the main liquid storages 24, 26 may escape via the openings 41, 43 provided in the upper area of these main liquid storages 24, 26 or, respectively, via the seals 40, 42 associated with these and having respective ventilation arrangements.

A liquid discharge opening 45 that can be closed via a seal 46 is also provided at the liquid buffer 28 which, for example, may fashioned from plastic material (preferably PE material) as a rotating injection mold part and fixed to the machine frame 12 by means of tension belt attachment. Liquid contained in the main liquid storages 24, 26 or, respectively, the main liquid pipes 30, 32 may be discharged via this discharge opening 45. Furthermore, a liquid filter arrangement may be supported on the seal 46 (which may be designed as a screw top) that terminates the liquid discharge opening 45, such that this may be easily removed from the liquid buffer 28 and cleaned upon removal of the seal 46.

A liquid dispensing member 48 designed (for example) as a water tap is further provided at the liquid buffer 28. This may be used in that personnel working in the area of the soil compactor 10 may, for example, clean their hands with the liquid stored in the main liquid storages 24, 26 or, respectively, also in the liquid buffer 28.

The liquid buffer 28 may also be associated with a fill level detection arrangement. For example, this may work depending on pressure in the liquid buffer 28 so that, based on the detected liquid pressure, it may be concluded to what extent the main liquid storages 24, 26 positioned vertically above the liquid buffer 28 are still filled with liquid.

In order to ensure that, after performing a pressurized filling operation via the filling connection 44 and the removal of a tube used for pressurized filling and connected to the filling connection 44, the liquid contained in the liquid buffer 28 or, respectively, the main liquid storages 24, 26 does not drain again through the filling connection 44, a valve assembly (preferably a check valve assembly) is preferably associated with the filling connection 44, which valve assembly only ensures an inflow of liquid into the liquid buffer 28 but prevents the escape of liquid from the liquid buffer 28 through the filling connection 44. As previously stated above, the discharge of liquid may happen via the liquid discharge opening 45 closed by the seal 46.

From the lower area of the liquid buffer 28, an intermediate liquid pipe 50 leads off to two first liquid pumps 52, 54 and a second liquid pump 56. These three liquid pumps 52, 54, 56 are mutually connected in parallel to the intermediate liquid pipe 50 and thus accept liquid in parallel with one another from the intermediate liquid pipe 50. The two first liquid pumps 52, 54 are also connected in parallel to a first liquid dispensing pipe 58. The first liquid dispensing pipe 58 leads away from the two first liquid pumps 52, 54 and is branched into two first branch pipes 60, 62. Each first branch pipe 60, 62 leads to a respective first liquid discharge unit 64, 66. The first liquid dispensing unit 64 is associated with the compactor roller 14 and includes a plurality of liquid dispensing nozzles 68 successively arranged in direction of the compactor roller rotational axis and spraying liquid on the surface of the compactor roller 14 during transport operation of the first liquid pumps 52 or, respectively, 54. These liquid dispensing nozzles 68 may be provided on a distributing pipe 70 positioned along the compactor roller 14, preferably across a stripper also associated with the compactor roller 14. The liquid sprayed via the liquid dispensing nozzles 68 onto the compactor roller 14 in an area above a stripper is additionally distributed by the stripper resting on the surface of the compactor roller 14, such that a full-surface wetting of the compactor roller 14 with the liquid dispensed from the first liquid dispensing unit 64 is ensured.

In a corresponding manner, the first liquid dispensing unit 66 is associated with the other compactor roller 16. This first liquid dispensing unit 66 interacting with the compactor roller 16 also comprises a distributing pipe 72 preferably extending across a stripper associated with the compactor roller 16, said distributing pipe 72 having a plurality of liquid dispensing nozzles 74 provided thereon.

In compaction operation, the liquid contained in the main liquid storages 24, 26 and flowing via the main liquid pipes 30, 32 into the liquid buffer 28 due to gravity may be removed from the liquid buffer 28 by one of the two first liquid pumps 52, 54 via the intermediate liquid pipe 50, and be fed via the first liquid dispensing pipe 58 and the two first branch pipes 60, 62 to the first liquid dispensing units 64, 66. In this case, the dimensioning of the first liquid pumps 52, 54 is chosen so that each one of them has a sufficient conveying capacity to feed both liquid dispensing units 64, 66 with sufficient liquid. The provision of two first liquid pumps 52, 54 connected in parallel ensures that, in the event of a failure of one of the pumps, work can be immediately continued with the other so that an interruption in the liquid feed to the two liquid dispensing units 64, 66 may be avoided.

The second liquid pump 56 also withdrawing liquid from the liquid buffer 58 via the intermediate liquid pipe 50 delivers this liquid into a second liquid dispensing pipe 76. The second liquid dispensing pipe 76 branches into two second branch pipes 78, 80. Each second branch pipe 78, 80 leads to a second liquid dispensing unit 82 or, respectively, 84. Each of these second liquid dispensing units 82 or, respectively, 84 may comprise one or more liquid discharge nozzles 86, 88. The liquid conveyed by the second liquid pump 56 via the liquid discharge nozzles 86, 88 can be discharged in direction of a respective edge treatment device 34 or, respectively, 34'. For example, the liquid may be sprayed onto the respective edge treatment wheel 38 or, respectively, 38' of the edge treatment device 34 or, respectively, 34' while this rotates around a rotational axis during the edge treatment operation. As was already mentioned above, each of these two edge treatment devices 34, 34' may respectively be associated with one of the two compactor rollers 14, 16, advantageously distributed to the two sides of the soil compactor 10.

Liquid can be conveyed by the second liquid pump 56—connected in parallel with the two first liquid pumps 52, 54—to the second liquid dispensing units 82, 84 regardless of the operation of the first liquid pumps 52, 54, and in fact even in the quantity that is necessary or advantageous for this. Since significantly less liquid generally needs to be conveyed to the edge treatment devices 34, 34' in the edge treatment operation than is necessary for the two compactor rollers 14, 16, the second liquid pump 56 may be designed with a lower maximum delivery (i.e. volumetric displacement per unit of time) than the two first liquid pumps 52, 54. This results in that, when a liquid supply to the two first liquid dispensing units 64, 66 is not needed during an edge treatment operation, considerably less energy needs to be expended in order to covey liquid, since only a comparatively small-sized liquid pump—namely, the second liquid pump 56—is to be operated. Furthermore, the second liquid pump 56 may also be designed or, respectively, activated for a different conveying mode, for example an intermittent conveying operation.

In order to also be able to empty the pipe areas disposed below the liquid discharge opening 45, in particular when the liquid pumps 52, 54, 56 are arranged vertically below the liquid buffer 28, a connector 90 that is closable by a valve or, respectively, tap may, for example, lead away from the intermediate liquid pipe 50 or, respectively, the lowermost pipe area, through which connector 90 the liquid can drain while the valve or, respectively, tap is open. For example, antifreeze may also be fed into the pipe system via this connector 90 in order to convey this to the various liquid discharge nozzles 68, 74, 86, 88, for example in a short conveyor operation of liquid pumps 52, 54, 56. Thus it can be ensured that, at low ambient temperatures upon decommissioning of the soil compactor 10 (for example overnight), the liquid still present in the liquid discharge nozzles 68, 74, 86, 88 or, respectively, in the pipe areas leading thereto does not freeze.

The soil compactor 10 previously described with reference to FIGS. 1 and 2 includes a plurality of aspects that are particularly advantageous in combination but also individually have positive effects. This is on the one hand the possibility of one or, respectively, multiple main liquid storages 24, 26 to be filled via a filling connection 44 jointly associated with these, especially when carrying out a pressurized filling operation, for which the aspect is advantageously utilized that the main liquid pipes 30, 32 may be used not only for emptying the main liquid storages 24, 26 but also for filling of the same. Another very advantageous aspect of the soil compactor 10 according to the invention is that the various system areas to be supplied with liquid (generally water), in which system areas there are different requirements with regard to the required amount of water (namely the compactor rollers 14, 16 on the one hand and the edge treatment devices 34, 34' on the other hand), may independently of each other be fed via first liquid pumps 52, 54 or, respectively, a second liquid pump 56 respectively associated with these system areas. Each of these system areas or, respectively, each of these liquid pumps 52, 54, 56 can thus be built with optimum configuration aspects for the respective operation, in particular with a sufficient maximum flow capacity, without this entailing a negative effect on the functionality in supplying liquid to another respective system area.

It should be noted that the aspect that both main liquid storages 24, 26 may be filled via a common filling connection 44 can also be realized when several (for example two) main liquid pipes are associated with each main liquid storage 24, 26. For example, a main liquid pipe could then lead from each main liquid storage 24, 26 to the liquid buffer 28, while respectively another main liquid pipe could lead to the filling connection 44 (which then is not provided at the liquid buffer 28, for example), so that the main liquid storages 24, 26 may then be filled together via these additional main liquid pipes.

The invention claimed is:

1. A soil compactor comprising:

at least one compactor roller rotatable about a rotational roller axis, and a liquid storage/dispensing system for storing and dispensing liquid to the at least one compactor roller, the liquid storage/dispensing system comprising at least two main liquid storages and main liquid pipes associated with the at least two main liquid storages, wherein the main liquid pipes of the at least two main liquid storages are in connection with a common filling connection for a parallel filling of the at least two main liquid storages associated with the common filling connection.

2. The soil compactor according to claim 1, wherein at least one main liquid storage of the at least two main liquid storages is in connection with a liquid buffer via a respective main liquid pipe, wherein the filling connection for filling the at least one main liquid storage connected via the liquid buffer is associated with said liquid buffer.

3. The soil compactor according to claim 2, wherein the main liquid pipes of the at least two main liquid storages establish a connection between the at least two main liquid storages and the liquid buffer.

4. The soil compactor according to claim 2, wherein the filling connection is provided in a lower area of the liquid buffer, or the liquid buffer is arranged vertically below the at least one main liquid storage.

5. The soil compactor according to claim 1, wherein the main liquid pipe of at least one of the at least two main liquid storages is in connection with at least one liquid pump.

6. The soil compactor according to claim 5, further comprising an intermediate liquid pipe that leads from the liquid buffer to at least one liquid pump.

7. The soil compactor according to claim 5, wherein the at least one liquid pump is in connection via a liquid dispensing pipe with at least one liquid dispensing unit comprising a plurality of liquid dispensing nozzles.

8. The soil compactor according to claim 7, wherein at least two liquid pumps are provided connected in parallel between the intermediate liquid pipe and the liquid dispensing pipe.

9. The soil compactor according to claim 1, wherein:

two compactor rollers are provided, each compactor roller is associated with a liquid dispensing unit, and a respective main liquid storage of the at least two main liquid storages is arranged above each compactor roller.

10. The soil compactor according to claim 2, further comprising a liquid discharge opening or a liquid dispensing member provided at the liquid buffer.

11. The soil compactor according to claim 2 wherein the liquid buffer:

is constructed of plastic material, or is fixed on the machine frame by a tension belt attachment, or is designed as a rotating injection mold part.

12. The soil compactor according to claim 1, wherein:

the filling connection is formed as a pressurized tube connection, or the filling connection is designed as a tilt angle connection, or a valve assembly substantially preventing the escape of liquid from the liquid buffer through the filling connection is associated with the filling connection, or a fill level detection arrangement is associated with the liquid buffer.

13. The soil compactor according to claim 1, wherein the at least two main liquid storages can be filled and emptied via the main liquid pipes associated with the at least two main liquid storages.

* * * * *